US006402647B1

(12) United States Patent
Haseltine

(10) Patent No.: US 6,402,647 B1
(45) Date of Patent: Jun. 11, 2002

(54) KICK-STRENGTHENING SOCCER PRACTICE BALL, AND PRODUCTION AND TRAINING

(76) Inventor: Arthur S. Haseltine, 4741 S. Warwick Ave., Springfield, MO (US) 65804

( * ) Notice: Subject to any disclaimer, the term of this patent is extended or adjusted under 35 U.S.C. 154(b) by 0 days.

(21) Appl. No.: 09/512,992

(22) Filed: Feb. 24, 2000

Related U.S. Application Data

(60) Provisional application No. 60/121,630, filed on Feb. 25, 1999.

(51) Int. Cl.[7] ..... A63B 41/10

(52) U.S. Cl. ..... 473/605; 473/604; 473/599; 473/423; 473/425; 473/609; 473/430

(58) Field of Search ..... 473/599, 601, 473/602, 603, 604, 605, 609, 610, 446, 423, 424, 425, 426, 427, 429, 430

(56) References Cited

U.S. PATENT DOCUMENTS

| | | | | |
|---|---|---|---|---|
| 1,187,029 A | | 6/1916 | Beebout | 473/604 |
| 1,642,462 A | | 9/1927 | Reach | |
| 2,784,969 A | | 3/1957 | Brandon | |
| 3,506,265 A | | 4/1970 | Yugi | 473/604 |
| 3,963,236 A | | 6/1976 | Mann | |
| 4,026,561 A | | 5/1977 | Baldorossi et al. | |
| 4,042,241 A | | 8/1977 | Collins | 273/95 A |
| 4,071,241 A | | 1/1978 | Cortes Garcia | 273/55 B |
| 4,201,384 A | | 5/1980 | Barber | 273/199 R |
| 4,325,548 A | | 4/1982 | Piccini | 273/55 B |
| 4,462,590 A | | 7/1984 | Mitchell | 273/65 E |
| 4,542,902 A | * | 9/1985 | Massino | |
| 4,614,339 A | | 9/1986 | Schanwald | |
| 4,660,831 A | | 4/1987 | Kralik | 273/65 E |
| 4,754,969 A | | 7/1988 | Kobayashi | |
| 4,917,381 A | | 4/1990 | Spector | 273/58 H |
| 5,106,087 A | | 4/1992 | Simmons et al. | |
| 5,224,704 A | | 7/1993 | Snell | 273/65 EC |
| 5,261,661 A | | 11/1993 | Lemmon | 273/65 EC |
| 5,286,020 A | | 2/1994 | Caruso | 273/58 BA |
| 5,358,258 A | | 10/1994 | Killion | 273/414 |
| 5,681,233 A | | 10/1997 | Guenther et al. | 473/605 |
| 5,772,545 A | * | 6/1998 | Ou | |
| 5,782,727 A | | 7/1998 | Pierce | 482/129 |
| 5,788,591 A | | 8/1998 | Decker | |
| 6,231,454 B1 | | 5/2001 | Teramoto | |

OTHER PUBLICATIONS

Product catalog of "Kwik Goal;" Front cover, back cover, & p. 44 (1998), (Eg., the Caruso, *supra*, "MSB medicine ball" being shown in the lower left quarter of p. 44).

Product catalog Of "M–F Athletic Co.;" Front cover, back cover, & pp. 16–17 (1999).

Article, "Just for Kicks," Sports Illustrated, Front cover & pp. 56–60 (Oct. 4, 1999).

* cited by examiner

*Primary Examiner*—Paul T. Sewell
*Assistant Examiner*—Nini F. Legesse
(74) *Attorney, Agent, or Firm*—Jonathan A. Bay

(57) ABSTRACT

A kick-strengthening practice soccer ball is given a little extra weight but preferably softened also for enhance shock absorption when kicked. The practice ball has an inflatable bladder, a carcass of tough durable material, and an intermediary sheath of substantially non-stretchable, flexible material for restraining expansion of the bladder when inflated to pressure. Thus the sheath thereby reduces the outward pressure on the carcass while also increasing the dimensional stability of the ball. A shock-absorbing weighting material interposed between either the bladder and sheath or sheath and carcass. The weighting material accounts for between about 4% and 40% of the total weight of the practice ball when inflated to pressure. If a nominal average weight for a standard matchball is taken to be between 14 to 16 ounces, the weighting material adds an additional increment from anywhere between about 1 and 10 ounces. Given the foregoing, the weighting material cooperatively weights the ball for kick-strengthening purposes as well as is shock-absorbing to soften the impact when kicked.

20 Claims, 9 Drawing Sheets

KICK-STRENGTHENING SOCCER PRACTICE BALL, AND PRODUCTION AND TRAINING

CROSS REFERENCE TO PROVISIONAL APPLICATION(S)

This application claims the benefit of U.S. Provisional Application No. 60/121,630, Feb. 25, 1999.

BACKGROUND OF THE INVENTION

1. Field of the Invention

The invention relates to a soccer practice ball and, more particularly, to a kick-strengthening soccer practice ball as well as. its production and methods of training with it.

Briefly stated, the inventive practice ball optionally weighs something more than a regulation game ball, but not nearly so much more as seen in prior art medicine balls. Those are too heavy, and are unsafe for kicking. Also, the inventive practice ball preferably has a shock-absorbing softness to it. That way, the softer impact felt during kicking practice likely eliminates repetitive stress injuries. Weighting the ball while softening it too can be achieved together by any of (i) replacing the prior art padding layer (if any) with a thicker layer, (ii) placing additional padding underneath the carcass knowing that the inflating the bladder will compress such padding into the carcass, or (iii) using heavier carcass material.

In most other respects, the inventive practice ball is produced for otherwise closely resembling a regulation "game" ball of applicable international standards. It has virtually the same circumference, and takes virtually the same inflation pressure(s).

2. Prior Art

The standard measure of a "game" ball for soccer has been established under the authority of an international federation, or FIFA. That standard recites some of the following. The soccer ball shall be spherical. The outer casing shall be leather:—however, there is some admittance for other approved materials. The circumference of the ball shall not be more than 28 inches (71 cm) and not less than 27 inches (68-½ cm). The weight of the ball at the start of a game shall not be more than 16 ounces (396 grams) or less than 14 ounces (453 grams). The inflation pressure shall be between 0.6 and 1.1 atmospheres (600 and 1,100 millibar) at sea level. Although, nowadays it is far more typical to maintain the ball pressure in an official match within a narrower band, say, between about 0.9 and 1.1 atmospheres. See, eg., the International Matchball Standards of the FIFA.

Regulation game balls are available off-the-shelf from numerous commercial sources. There is a surprising variety in the construction of these game balls. Yet there are several shared aspects which consistently appear in the game balls known to date. These include the following. The carcass is typically constructed from panels. Some designs have thirty-two (32) panels, others have eighteen (18), and still others have just eight (8). The thirty-two (32) panel variety is the one most familiar to the inventor hereof. Hence the thirty-two (32) panel soccer ball evidently comprising about twelve (12) pentagonal panels evenly mixed among twenty (20) hexagonal panels, arranged along each one's edges and sewn together to form seams to give the approximate overall "spherical" shape. The panels are generally produced from leather, although other synthetic materials are common nowadays. The eight and eighteen (8 and 18) panel soccer balls are likewise produced by panels meeting at seams, irrespective of the differing geometries for the panels. Hence what is so commonly referred to as the "carcass" is in fact a pieced-together construct of panels.

Inflation is sustained by a bladder. A typical bladder comprises a natural or synthetic rubber (eg., butyl rubber), or admixture (eg., 20% natural and 80% butyl rubber), having a uniform wall thickness and inflatable into a spherical shape.

The bladder and carcass aside, there is typically at least one other component:—ie., something that serves to constrain expansion of the bladder from expansion beyond a given measured, circumferential limit. Many materials have been used in service of expansion constraint. In U.S. Pat. No. 5,681,233—Guenther et al., the basketball disclosed thereby of Wilson Sporting Goods Co. has a winding for constraining the bladder from over-expansion. The winding comprises about 2100 meters of 210 denier Nylon 66 thread. In U.S. Pat. No. 4,462,590–Mitchell, the football disclosed thereby of Figgie International Corp. has a sheath around the bladder for restraining expansion of the bladder when inflated. As recited therein, > . . . When the ball is inflated to its full playing pressure, the sheath should be strong enough to contain a relatively large percentage (but not all) of the pressure forces, so that the net force exerted against the carcass is only about 1–5 psi [eg., wherein full playing pressure for a football is about 13 psi]. It is necessary that at least some force be exerted against the carcass to maintain it taut. It has been found that polyurethane film sold by Tetra Plastics Inc. of St. Louis, Mo. under the designation TP400 has the requisite properties for sheath material. This film has a thickness of about 0.018 in. (0.046 cm.) . . . .
>
> . . . [In use,] the bladder may then be inflated to expand and stretch the sheath until it substantially conforms to the inside walls of the carcass. As noted hereinabove, the material out of which the sheath 19 is made is sufficiently strong that the force exerted against the inside of the carcass is relatively small (eg., 1–5 psi in the case of a football) so as not to subject the carcass to excessive internal pressures which would otherwise tend to cause the carcass to lose its shape relatively quickly. Column 3, lines 3–13, and column 4, lines 46–55.

Another sheath-type of construction used in soccer balls is to apply woven material directly as a backing to each individual leather panel. Hence the carcass of such a ball comprises a dual-layer carcass, ie., an outer leather layer and an inner woven-sheath backing. An inflatable bladder is incorporated as customary to "float" (not be attached) inside the carcass, its inflation pressure and nipple tending to stabilize the bladder in position. In the majority of cases, the sheath layers—while relatively rigid when stretched tight by an inflated bladder—also are collapsible under deflation to permit compaction for shipping and bulk handling purposes.

The U.S. Pat. No. 5,286,020 of Caruso, discloses a heavy, 32 ounce (2 lbs or 0.9 kg) medicine ball for soccer practice. The Caruso medicine ball is unsuitable for kick-strengthening purposes, and neither the patent nor the inventor's commercial literature makes and dispute about that. With reference to the patent, it discloses preferred ranges of dimensions for construction of the Caruso medicine ball. This medicine ball is available on the market and, in the commercial literature for it, the Caruso medicine on is listed at weighing 2 lbs (0.9 kg). It also inflated to just a low pressure. More particularly, > When it is used, the medicine ball is inflated to a low pressure such as 2–10 psi, expanding the bladder so that it will lightly contact the inside cover 14. At such low pressures the ball is softer, more pliable and more deformable than standard inflatable sport balls, and the ball has a lower coefficient of elastic resolution than conventional sport balls. Because the walls of the bladder 18 are thick and the inflation pressure low, the ball can be grasped easily even by a small child. Because it is pliable, the ball cannot be bounced, and should not be kicked or headed . . . .

. . . It has a sturdy leather or plastic cover and inflatable inner bladder of sufficient thickness that, at relatively low inflation pressures, permits the ball to be lighter in weight than conventional medicine balls yet pliable so that it easy to throw or catch, even for children. The lighter ball is less likely to cause injuries [than standard lead-weighed medicine balls], but as with standard medicine balls should not be kicked or headed like a soccer ball. Column 2, line 59, continuing into column 3, line 1, and column 1, lines 41–53.

These warnings regarding "NOT TO BE USED FOR KICKING OR HEADING" are repeated as stated in both the commercial literature and directly applied onto the Caruso medicine ball, selling under the Kwik Goal Ltd. (Quakerstown, Pa.) brand name.

What is needed is an improvement which overcomes the shortcomings of the prior art for kick-strengthening training for soccer athletes.

SUMMARY OF THE INVENTION

It is an object of the invention to provide a kick-strengthening soccer practice ball.

It is an additional object of the invention to arrange the above practice ball so that it weighs slightly more than a regulation game ball, but is inflated to about the same pressures to yield a comparable "coefficient of elastic resolution" as a regulation ball. However, preferably the target "coefficient of elastic resolution" is indeed just slightly lessened by incorporation of a shock-absorbing layer beneath the carcass. Such a shock-absorbing layer shall spread the forces of kicking-impact over a minutely bigger time span to lessen the stress felt by a trainee while kicking the practice ball.

It is an alternate object of the invention to convert a regulation soccer ball into the inventive practice ball by inserting extra under the carcass, and hence add between about 2 and 10 ounces (56 and 280 grams) of increased weight.

It is a further object of the invention to produce the practice ball in a set, each ball of such a set having a progressively different weight. Hence kick-strengthening training occurs with progressively heavier or lighter balls—much like how an athlete in weight training resorts to a dumbbell rack with different weight gradations among dumbbells. The gradations may occur in 2 ounce (56 gram) steps or so, between the preferred extremes of 2 and 10 ounces (56 and 280 grams) of increased weight.

These and other aspects and objects are provided according to the invention in a kick-strengthening soccer practice ball. One version of the invention is achieved by converting a regulation game ball into a practice ball in accordance with the invention by symmetrically distributing a patchwork of padding material as a backing material onto some or all of the leather panels of the carcass. It is preferred if between about 2 and 10 ounces (56 and 280 grams) of increased weight is added thereby.

Optionally the inventive practice ball can be produced in a set, each ball of such a set having a progressively different weight. Hence kick-strengthening training occurs with progressively heavier or lighter balls—much like how an athlete in weight training resorts to a dumbbell rack with different weight gradations among dumbbells. The gradations may occur in 2 ounce (56 gram) steps or so, between the preferred extremes of 2 and 10 ounces (56 and 280 grams) of increased weight.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIG. 16 is a pictorial view of a training method with the practice ball in accordance with the invention wherein a trainee is practicing a passing drill with the inventive practice ball such as feinting (faking) a pass; and, FIGS. 17 and 18 are pair of comparable views of pass drills with the practice ball in accordance with the invention wherein:

DETAILED DESCRIPTION OF THE PREFERRED EMBODIMENTS

Figure 1:
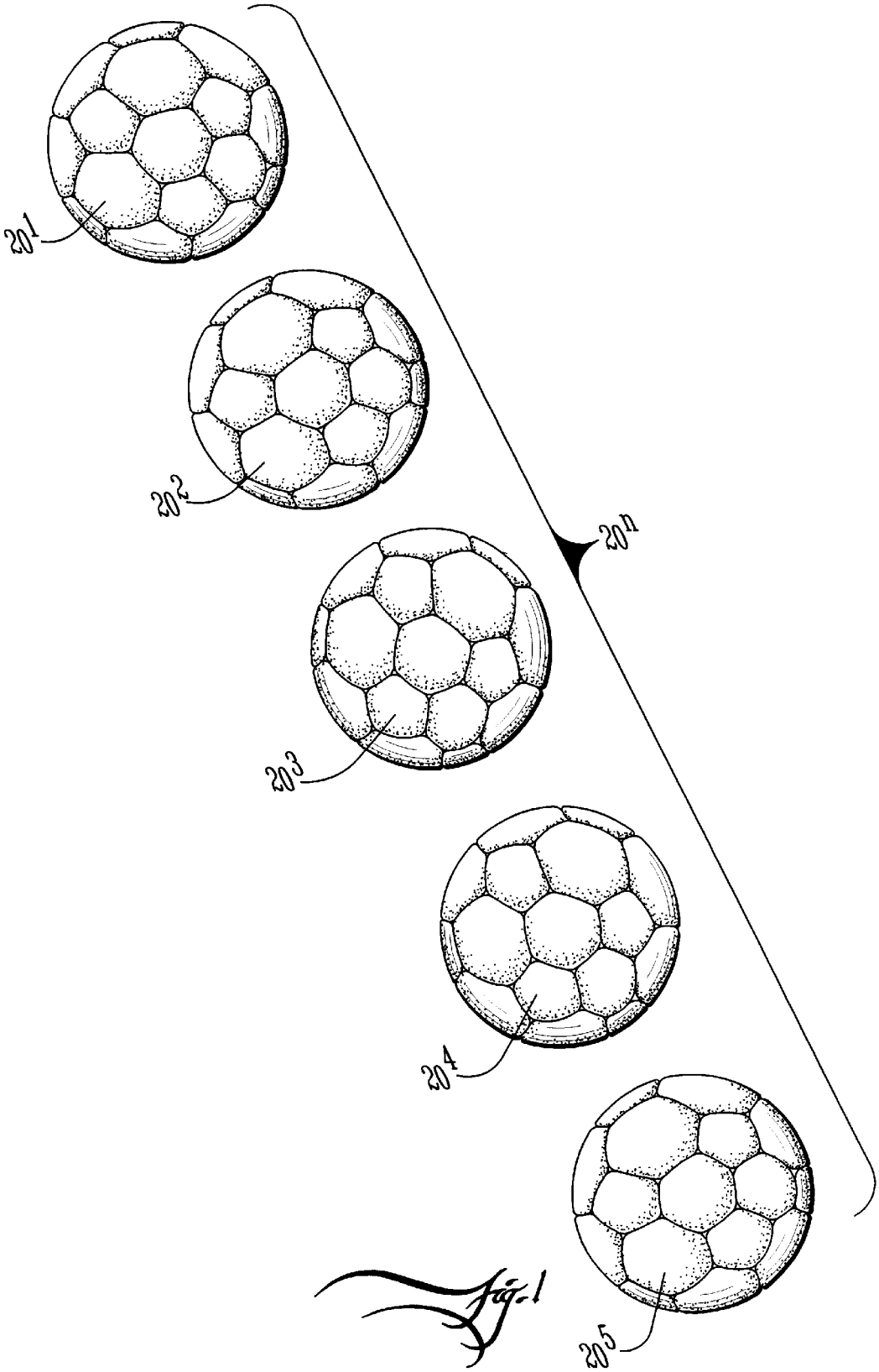
FIG. 1 is a perspective view of a set of kick-strengthening soccer practice balls in accordance with the invention, each in being progressively heavier than the previous.

FIG. 1 shows a set of kick-strengthening soccer practice balls $\mathbf{20}^1$ through $\mathbf{20}^5$ in accordance with the invention. Each ball of the set weighs progressively heavier than the previous as progression is made from the topmost ball $\mathbf{20}^1$ in the view, on through balls $\mathbf{20}^2$, $\mathbf{20}^3$, $\mathbf{20}^4$, and until $\mathbf{20}^5$ at the bottom. In a preferred arrangement of such an inventive set $\mathbf{20}^1$ through $\mathbf{20}^5$ each ball is one step heavier than the previous by about 2 ounces (56 grams). More particularly, for example, the first ball of the series $\mathbf{20}^1$ may weigh in at regulation-game ball weight, plus 2 ounces (56 grams). By the standards of an international authority, the weight of a regulation game ball must measure between 14 ounces (453 grams) and 16 ounces (396 grams).

Therefore, the second ball of the series $\mathbf{20}^2$ may weigh in at regulation-game ball weight plus 4 ounces (112 grams). And so on, as the third ball $\mathbf{20}^1$ weighs in at regulation-game ball weight plus 6 ounces (168 grams), the fourth ball $\mathbf{20}^4$ at regulation-game ball weight plus 8 ounces (224 grams), and ball $\mathbf{20}^1$ at regulation-game ball weight plus 10 ounces (280 grams). In the drawings, the inventive practice ball $\mathbf{20}^n$ et seq. is shown as a member of a set of five. However, any given one of such kick-strengthening soccer practice balls $\mathbf{20}^n$ has independent. utility without any of the others. Accordingly, inclusion of any one of the inventive balls (say, eg., $\mathbf{20}^3$) in a combination with one or more of balls $\mathbf{20}^1$, $\mathbf{20}^2$, $\mathbf{20}^4$ or $\mathbf{20}^1$ is shown in the drawings merely for convenience in this description and does not limit the invention to a "set" of balls only. Likewise, in instances where in context the invention pertains indeed to a "set" of such balls $\mathbf{20}^1$ through $\mathbf{20}^n$, there is no requirement that such a "set" contain five balls, or that the step gradations comprise equal, steps let alone 2 ounce (56 gram) steps. The foregoing example of a set of five balls distributed by 2 ounce (56 gram) steps is given so merely for convenience of a non-limiting example in this description and does not otherwise limit the invention.

Preferably any given kick-strengthening soccer practice balls $\mathbf{20}^n$ in accordance with the invention is characterized by the following aspects. Each ball $\mathbf{20}^n$ preferably measures the regulation circumference allowed for regulation game balls, ie., between about 27 inches (68-½ cm) and 28 inches (71 cm). Also, each ball $\mathbf{20}^n$ preferably is inflated to the nowadays "customary" inflation pressure and within the allowable range for regulation game balls, ie., between 0.9 and 1.1 atmospheres (900 and 1,100 millibar) at sea level. Additionally, each ball $\mathbf{20}^n$ preferably is constructed of an approved casing material (predominantly but not exclusively leather), sewn of panels. In this particular example, each ball $\mathbf{20}^n$ belongs the thirty-two (32) panel variety, and not an eight or eighteen (8 or 18) panel variety as also known. It does not matter in regards to the invention what kind of construction the carcass has, whether it is made from panels at all or not. The use in this description of a thirty-two (32) panel design ball is given so for convenience in this description for sake of example and is otherwise not limiting to the invention.

With that said, the carcass shown by the drawings comprises a mix of pentagons and hexagons as is conventional for thirty-two (32) panels designs, so that in most respects the practice ball $\mathbf{20}^n$ has much the of the "feel" of a regulation game ball. This feel includes the characteristic parameter which has come to be known as the "coefficient of elastic resolution." The coefficient of elastic resolution is a factor of various things including, as described in some detail above, the outward expansion of a properly inflated bladder against a restraining sheath. Such a restraining sheath eliminates the inflated bladder from acting too directly on the leather (or whatever) carcass otherwise the carcass would tend to creep over time, and grow, and hence lose its shape relatively quickly. The "International Matchball Standards" of FIFA contains a listing of approved materials. A regulation game ball constructed in accordance with such approved materials, in such measures as given by the standards, and inflated accordingly, is going to exhibit a characteristic "coefficient of elastic resolution" which experienced soccer players can recognize more or less by feel. Whereas it is not exact science, experienced soccer players can discern non-regulation balls pretty much by the relative excess sogginess or tautness in the carcass of the ball, by squeezing it or kicking it and so on.

It is an object of the invention that any given kick-strengthening soccer practice ball $\mathbf{20}^n$ in accordance with the invention has about the same coefficient of elastic resolution that is known by experienced players as regulation game balls have.

However, preferably the target "coefficient of elastic resolution" is indeed just slightly lessened of "softened" by incorporation in the kick-strengthening soccer practice ball $\mathbf{20}^n$ a particular shock-absorbing layer beneath the carcass. Such a shock-absorbing layer operates • to spread the forces of kicking-impact as felt when kicking the practice ball $\mathbf{20}^n$ • over a minutely bigger time span. That way the stress felt by a trainee while kicking the practice ball is slightly lessened. This ought to eliminate repetitive stress injury.

Figure 2:
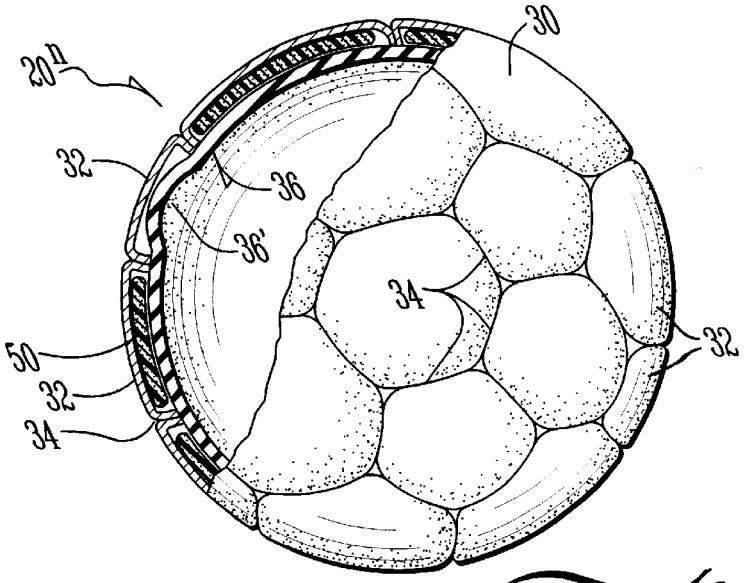
FIG. 2 is an enlarged perspective view of a given one of the practice balls in FIG. 1, except with portions broken away and partly in section.
Figure 3:
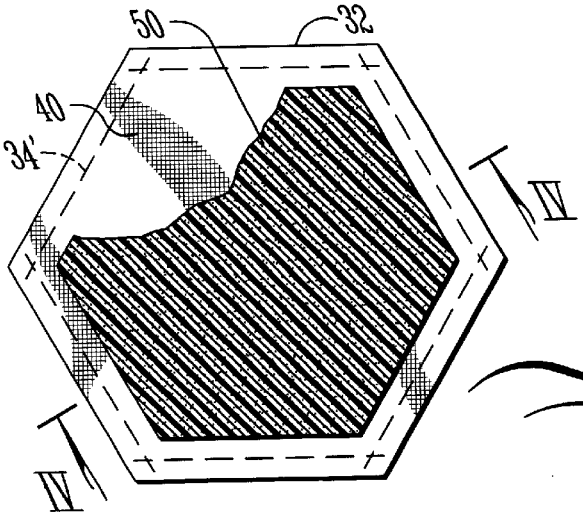
FIG. 3 is an enlarged plan view of an inner surface of a given hexagonal panel of the ball in FIG. 2, as stretched out flat prior to being sewn into the array of the carcass as whole, wherein portions of a foam rubber build-up are partly removed to better show the woven-fabric sheath lining.
Figure 4:
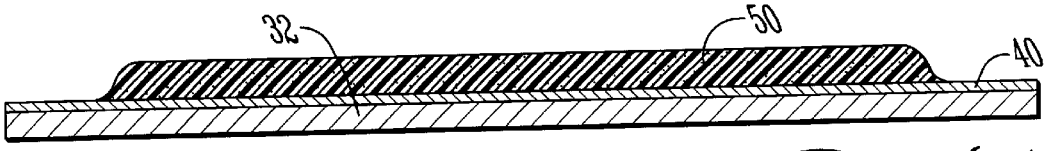
FIG. 4 is an enlarged sectional view taken along the line IV—IV in FIG. 3.

FIGS. 2 through 4 show how the foregoing objects and aspects of the invention are achieved in the production of the inventive kick-strengthening soccer practice ball $\mathbf{20}^n$. FIG. 2 shows what originally was a regulation game-ball but which has been converted into a kick-strengthening soccer practice ball $\mathbf{20}^n$ in accordance with the invention, by some of the following procedures.

Preliminarily, the kick-strengthening soccer practice ball $\mathbf{20}^n$ is conventional in many respects. It preferably has a leather carcass 30, although multiple other approved and non-approved materials will suffice. The carcass 30 is a composite of about thirty-two panels (several of which are indicated by reference numeral 32) arranged in a spherical array of twenty hexagonal panels and twelve pentagonal panels. The panels 32 are attached to one another along turned-in sewn seams 34. The carcass 30 surrounds an inflatable bladder 36 as is also conventional.

The section-cut portions of FIG. 2 show that the border of each sewn panel 32 is delimited by the in-turned seams 34, which seams 34 sort of define a lattice of miniature flanges inside the carcass 30. The spot of the bladder 36 indicated as 36' shows a bulge therein as the bladder 36 deforms locally within inter-seam gap against one panel 32 as between its seams 34. However, in accordance with this particular ball 20$^n$, that bulge 36' is in view in only one place even though the section view affords viewing of four other candidate places where this bulging 36' could occur, but does not. In fact, the four other places incorporate a shock-absorbing pad material 50, as will be more particularly described below.

FIG. 3 is a plan view of an inner surface of a give n hexagonal panel 32 of the ball 20$^n$ in FIG. 2. The panel 32 is shown stretched out flat and at a time prior to sewing into the array of the carcass 30 as whole. The fold lines which will fold up (eg., "up" given the vantage point of FIG. 3) are indicated as 34'. The panel 32 is lined edge-to-edge with woven fabric sheath 40. Whereas much of the industry prefers to use a synthetic polymeric sheath or woven nylon twill, it is believed that other materials have been approved in the FIFA standards also. The sheath serves among other purposes, the purpose of constraining the expansion of the bladder 36 beyond a given limit.

An inventive aspect of this panel 32 is that it includes a synthetic foam rubber pad 50 bonded to the sheath material 40. The inventor hereof produced a proof-of-concept prototype pad 50 using mouse pad material that was handy on his desk. However, it is reckoned that many other materials will suffice for the purpose. To date it is preferred if the pad 50 is constructed of synthetic foam rubber materials including without limitation butyl rubbers and/or neoprene and the like. Whereas the drawing shows the pad 50 shaped as a slightly reduced-size hexagon to avoid interfering with formation of the seams 34, this is shown this way for convenience in this description and other shapes are just as suitable. Hence the depiction of a hexagon shape for the pad 50 that is affixed to a hexagon panel 32 is not limiting to the invention. The shape of the pad 50 need not match the shape of the panel. In fact trials have been conducted with triangular pads 50 (not shown) on hexagonal panels 32.

To turn to FIG. 4, it is an enlarged sectional view as taken generally along the line IV—IV in FIG. 3. In producing the above-mentioned proof-of-concept prototype, the leather panel 32 and its sheath lining 40 were obtained pre-assembled by the original equipment manufacturer. The leather panel 32 and its lining 40 seemed to be very securely fixed (however it was accomplished is not known for sure). The pad 50 was attached by use of spare amounts of a common type of room-temperature vulcanizing adhesive. The intent behind adhering the pad 50 to the lining 40 was more to it get to stay put long enough to reinsert the bladder 36 and inflate it rather than accomplish as permanent as bond as appears to exist between the lining 40 and panel 32.

To return to FIG. 2, it can be reckoned that each of the twenty or so hexagonal panels 32 has an inventive pad 50 attached to it as at the same time none of the pentagonal panels 32 do. Hence this explains why a bulge 36' is evident as shown. If the section cut would be continued around the carcass 30 more of such bulges 36' would be evident. What was achieved by "weighting" the ball this way with mouse pad material was a practice ball 20$^n$ weighing about 6 ounces (168 grams) heavier than what was started with.

The foregoing comprises one non-limiting example description of how to convert a prior art regulation game ball into a kick-strengthening soccer practice ball in accordance with the invention. In the foregoing example about twenty pads 50 were added to the ball and symmetrically distributed by virtue of padding only the hexagonal panels 32. However, other symmetrical distribution schemes exist which would be suitable for the purpose and hence the use of twenty pads 50 does not limit invention to that number and distributional scheme only as padding could be applied to a greater or lesser number of panels.

At this point, pause can be taken to reckon the following aspect of the kick-strengthening practice soccer ball in accordance with the invention.

In use, it is intended for inflation to a nominal pressure of about one (1) atmosphere at sea level. The FIFA standards admit a range of 0.6 to 1.1 atmospheres. It much more customary to see matches played with balls inflated to between 0.9 and 1.1 atmospheres. Hence, the practice ball is preferably inflated to something in this range of 0.9 and 1.1 atmospheres. For the sake of convenience of a round number, it is presumed that the average use of the practice ball will see it inflated to 1 atmosphere, more or less.

The production of the ball can be reckoned as produced from an inflatable bladder and an outer casing that covers the bladder and is formed of composite panels. In some constructions of the ball, all of the composite panels have an outer ply of a tough durable carcass material and a subjacent ply of substantially non-stretchable, flexible sheath material. The sheath restrains the expansion of the bladder when inflated to pressure, which accordingly reduces the outward pressure on the carcass material as well as increases the dimensional stability of the ball.

Weighting the ball can be accomplished in various ways. What has been described previously has at least some if not all the panels furthermore including foam patches subjacent the sheath material. The foam comprises between about 7% and 40% of the total weight of the practice ball when inflated to pressure. Of course, the foam is included both to weight the ball for kick-strengthening purposes as well as to soften the impact when kicked.

This foam accounting for between about 7% and 40% of the weight of the ball can be reckoned as, if the inflated ball is reckoned as measuring a baseline weight of about 14 to 16 ounces at sea level, plus an incremental amount more chosen from between about 1 and 10 ounces, then the weight of the foam corresponds to the incremental amount.

In other words, the weight of the inflated ball is taken as measuring a baseline weight of about 14 to 16 ounces at sea level, plus the incremental amount more, which incremental amount more might be added in accordance with step amounts of about "n" ounce(s) such that "n" is an integer chosen from 1 to 10. Experience now suggests that the best results are gotten by weighting the ball a mere 2 or 3 ounces. Virtually everybody who has handled a proof-of-concept proto-type weighted with three (3) ounces could tell that the ball was weighted. No one thought otherwise. Truly, three (3) ounces, is a 20% difference. The step amount of as little as one (1) ounce is significant because, in striving to produce balls weighted two (2) ounces more, the results often yield a mere one (1) ounce heavier ball. The one (1) ounce heavier balls nevertheless provide training improvements consistent with the training objects of the invention, which are more particularly shown and described in connection with FIGS. 7–18.

The patches are bonded or glued to the sheath only in sturdy enough condition to hold the patches there for so long as it takes to inflate the ball. The bladder will providing a clamping pressure on the patches when inflated which obviate the need for more securely bonding them in place.

A preferred embodiment of the ball has it produced such that the ball, excluding or subtracting from it the foam, is substantially a FIFA International Matchball Standards ball that, when before use and inflated to between 0.6 and 1.1 atmospheres (600 and 1,100 millibar) at sea level:

is spherical, has a circumference measuring not more than 28 inches (71 cm) and not less than 27 inches (68-½ cm), and weighs not more than 16 ounces (396 grams) or less than 14 ounces (453 grams).

There are other varieties of balls besides the foregoing. The FIFA matchball is more commonly known in the industry as a size no. 5 ball. However, there are youth leagues using smaller balls known as size no. 4 ball as well as down to a size no. 3 ball. The invention applies to these balls too.

Whereas the panels are shown mated by sewn seamed edges turned inward, other ways for producing paneled balls are known and the invention is correspondingly applicable to those balls as well. Some balls are provided having panel arrangements which utilize any of 32 in number, 18 in number, or 8 in number. The arrangement of 32 in number is shown by the drawings, it having 12 pentagonal and 20 hexagonal panels.

What has been referred to in abbreviated form as "foam" can comprise any suitable resilient material including any synthetic, natural, or admixture of synthetic and natural foam or sponge rubber.

An alternate version of the invention has the ball produced of a bladder, a carcass, an intermediary sheath, and the shock-absorbing foam material interposed between either the bladder and sheath or sheath and carcass. Again the foam preferably accounts for between about 7% and 40% of the total weight of the practice ball when inflated to pressure. The foam might be incorporated alternatively as either a substantially continuous layer or else as distributed in patches. The patches are preferably distributed in a symmetric distribution in a spherical geometry, for the purpose of lessening imbalance. FIG. 2 shows one such non-limiting example.

It will be appreciated that when less foam is used, the less the ball is softened thereby. Conversely, the more foam used, the softer the ball becomes if not becoming nearly dead. This is a happy coincidence, especially in consideration of reducing impact shock for avoiding if not eliminating repetitive stress injuries. The more foam, the heavier, and hence the greater need for greater softness and/or shock absorption. In the other direction, using less foam implies that the weighted ball is not really that much heavier than its un-weighted analog, and hence there is correspondingly less need for much shock absorption. Otherwise, a lightly weighted, soft ball can be likened to an un-weighted dead ball.

A further embodiment of the ball can be reckoned as having a composite construction including at least the bladder, the carcass, and the intermediary sheath. With only these last-recited components, the completed ball is produced weigh, when inflated, a nominal baseline weight of about 15 ounces at sea level plus an increment of about "n" ounces more, such that "n" is a value ranging from 2 to 10. The baseline weight corresponds to the weight of a standard FIFA matchball (eg., size no. 5 ball). The increment difference corresponds to the weighted portion that is advantageous for kick-strengthening training as shown by FIGS. 7–18.

However achieved, it is an object of the invention to add a small measure of weight to what would ordinarily qualify as a regulation game ball in the production of a kick-strengthening soccer practice ball 20$^n$ in accordance with the invention. Moreover, such additional weight preferably has the format of a soft, shock-absorbing material such as synthetic foam rubber and the like. It is preferred to raise the weight by a small measure in the range between about 2 and 10 ounces (56 and 280 grams).

In use, the kick-strengthening soccer practice ball 20$^n$ allows inventive methods of training not previously possible. The Caruso medicine ball referenced above specifically warns against heading and kicking. Besides also being too deflated, the more major problem is that it is too heavy.

Soccer is a major international sport which, it is amazing to say, lacks any consensus regarding the use of weight training as a means of strength training. For example, one text on the subject (that is available from a major publisher) has the following to say.

> When you see soccer players, you don't automatically think of muscles. They're not football players with big necks or softball players with big forearms. In fact, big is generally not what you think of when you think soccer. Instead, you think of lean, athletic-looking, long distance runners, because, of course, that's what they are.
>
> But strength training [vis-a-vis weight training] has its place in the game of soccer, and if you've ever taken a good look at a soccer payer's legs you'll know that there are some pretty big muscles being used and developed. Strength training, like flexibility training, can improve performance and prevent injury.

D. W. Crisfield, *The Complete Idiot's Guide to Soccer* (Simon & Schuster Macmillan 1999), p. 191.

Nevertheless a putatively more-highly regarded publication of the National Soccer Coaches Association of America warns soccer athletes away from weight training, as the following brief passage discloses.

> When talking about strength development of athletes, it more appropriate to use the term POWER since strength is component of POWER (Power=Force× Velocity). An athlete must not only be able to apply a great deal of force (which is strength) to the ground on each takeoff but he must also apply this force very quickly (velocity) since the duration of takeoff is a split second occurrence. In light of this important fact it is essential that the athlete have the ability to apply a large force in a very short time period. Pure strength is not enough, but rather the rate that this strength can be utilized. This why the Soviets developed the plyometric concept in the late 1960's for their jumpers.
>
> Plyometric exercises are those in which the exercised muscle is loaded in an eccentric (lengthening) contraction initially followed by immediately by a concentric (shortening) contraction. Numerous research studies have indicated that it is not the amount of dynamic exercise that is important but rather the rate at which the exercise is performed when attempting to develop one's power output. A concept that must be grasped at this point is that a muscle that is stretched prior to contraction will contract more forcefully. By loading a particular muscle in an eccentric fashion you are in effect stretching that muscle prior to its contraction which results in a more forceful contraction.
>
> The plyometric concept was developed by the Soviets when they asked themselves the question: 'Are slow strength exercises (the typical barbell ones) developing a strength that is transferable to high speed contractions by the same muscle?' After much research they concluded that the answer was NO.

[Emphasis in original.]

T. Schum, ed., *Coaching Soccer* (NTC/Contemporary Publishing Group, Chicago, 1996), p. 257.

Hence the two texts are diametrically opposed on the subject of weight training. One text preaches the advantages of weight training and is silent on plyometric training, as the other warns against weight training preferring instead to extol the virtues of plyometrics.

In asking who's is more right, it probably is that both are not wrong. Strength training and power development most likely require much variety in any given program, or else the body will adapt to a given program and respond less after time. It is a very familiar weight-training concept that trainees must change their routines every so often to continuously stimulate development. Variety in a training program is usually said to be desirable because (i) it provides a variety of movements to develop more completely any area of the body, hitting that area of the body from multiple angles, and (ii) to force the body to do new and unexpected movements to help shock it into further growth. Another point sometimes made is that variety eliminates boredom. To stay too long with one program allows the body to adapt very specifically to that program while depriving it of a more complete, balanced development In one memorable statement, Arnold Schwarzenegger captured much of the complacency that sets in when sticking to one program too long in a nutshell when he said:—"The hardest training routine is somebody else's."

Your muscles will only grow when they are subjected to an overload. They will not respond to anything less. As you grow stronger, the only way to make your muscles to continue to grow is by increasing the amount of work you force them to do. This is most easily done by increasing the amount of weight you use in each exercise. By progressively adding on weight to keep pace with the growing strength of your body, you ensure that your muscles will always be working at their maximum capacity and therefore grow as fast as possible.

A. Schwarzenegger, *Encyclopedia of Modern Bodybuilding* (Simon & Schuster 1985), p. 114.

Whether weight training or plyometrics, each serves a variety of advantages to the soccer athlete in establishing a base of strength and power. Each also has shortcomings. Neither program demands that the leg limbs and joints move in the natural planes of when a soccer player is kicking a ball. Not only that, but neither weight training nor plyometrics supply specific training for the timing involved in kicking a ball, nor coordination of the many secondary muscles that balance the body while a powerful leg strokes through a ball.

Instead, the benefits of a training program combining both progressive intensity (eg., increasing work) with natural movements and timing is provided only by the kick-strengthening soccer practice ball 20$^n$, allowing inventive methods of training unlike anything known or suggested by the prior art but only disclosed by the inventor hereof.

Figure 5:
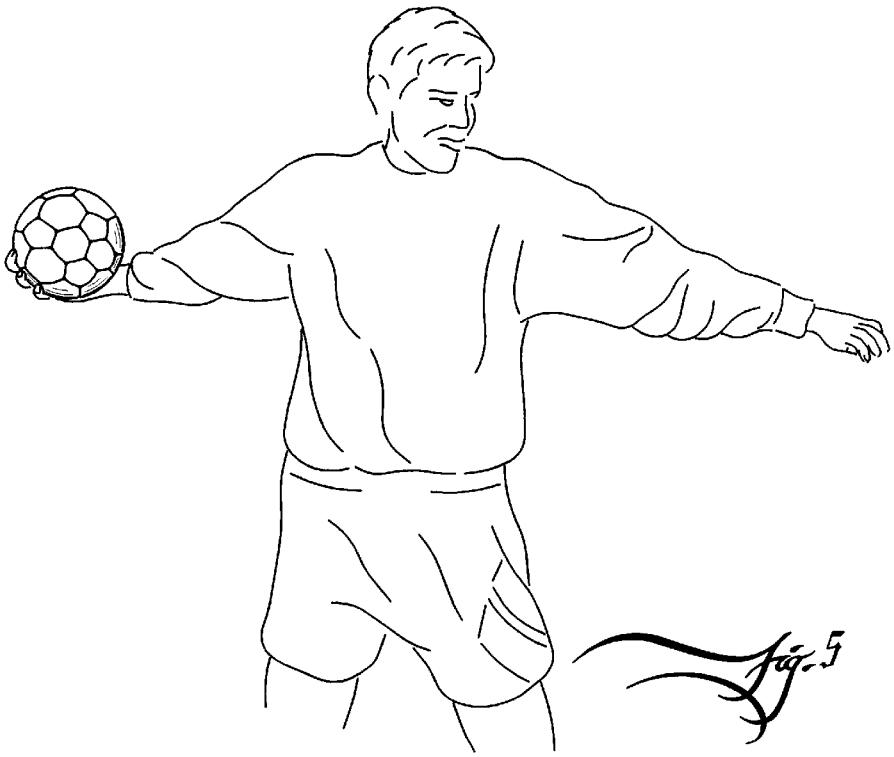
FIG. 5 is a pictorial view of a prior art training method of practicing "keeper throws" with a medicine ball in accordance with the prior art.
Figure 6:
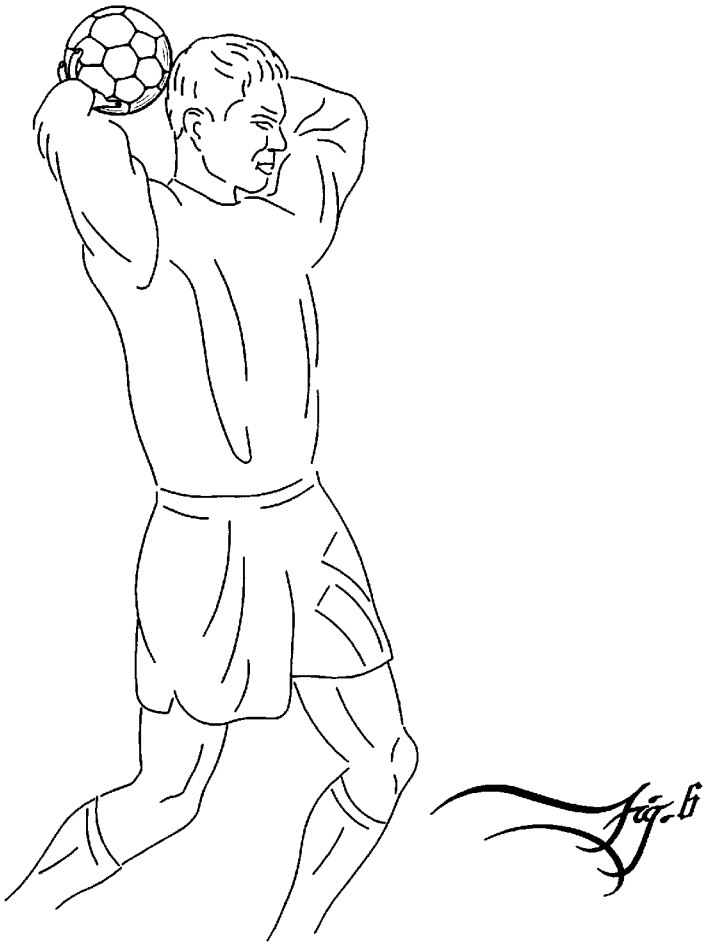
FIG. 6 is a pictorial view of a prior art training method of practicing overhead throws for both field and keeper positions, as practiced with the prior art medicine ball of FIG. 5.
Figure 7:
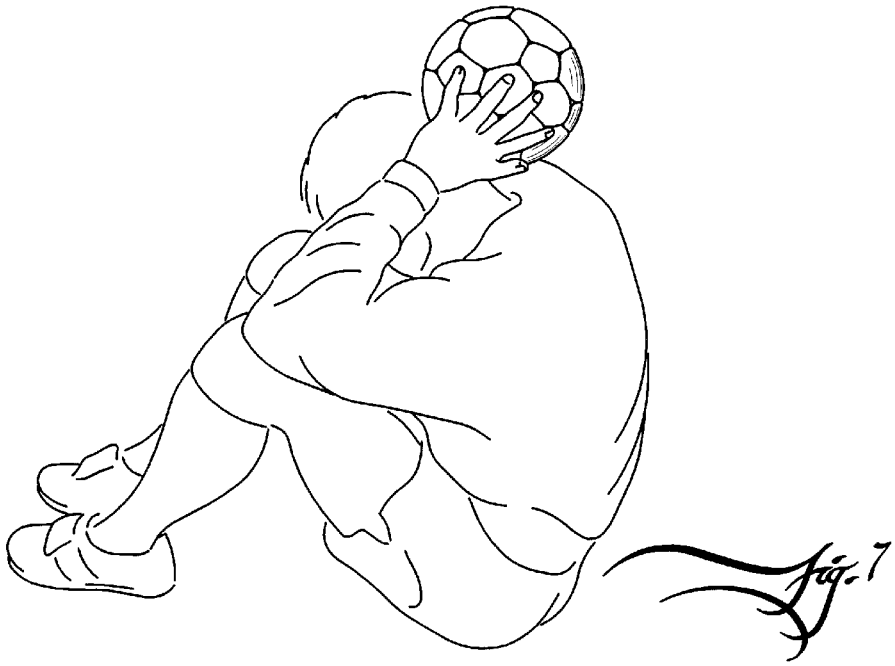
FIG. 7 is a pictorial view of a training method with the practice ball in accordance with the invention, wherein, a trainee is performing sit-ups to strengthen the same abdominal muscles used in the motion of an overhead throw as shown by FIG. 6.

FIGS. 5 and 6 show the prior art training method known with the Caruso medicine ball, referenced above. It allowed practice of throws such as a keeper practicing a one-armed throw as shown by FIG. 5 or a trainee playing either a field or keeper position practicing an overhead throw as shown in FIG. 6. The inventor hereof has discovered that the practice ball 20$^n$ in accordance with the invention allows being held as shown by FIG. 7 during sit-ups (or crunches), which will strengthen the same abdominal muscles used in the motion of an overhead throw as shown by FIG. 6. For example, compare the extension of the trainee's arms in both FIG. 6 and 7. In FIG. 7 he is training his abdomen for a more powerful "snap" for throwing the ball as shown by FIG. 6.

Figure 8:
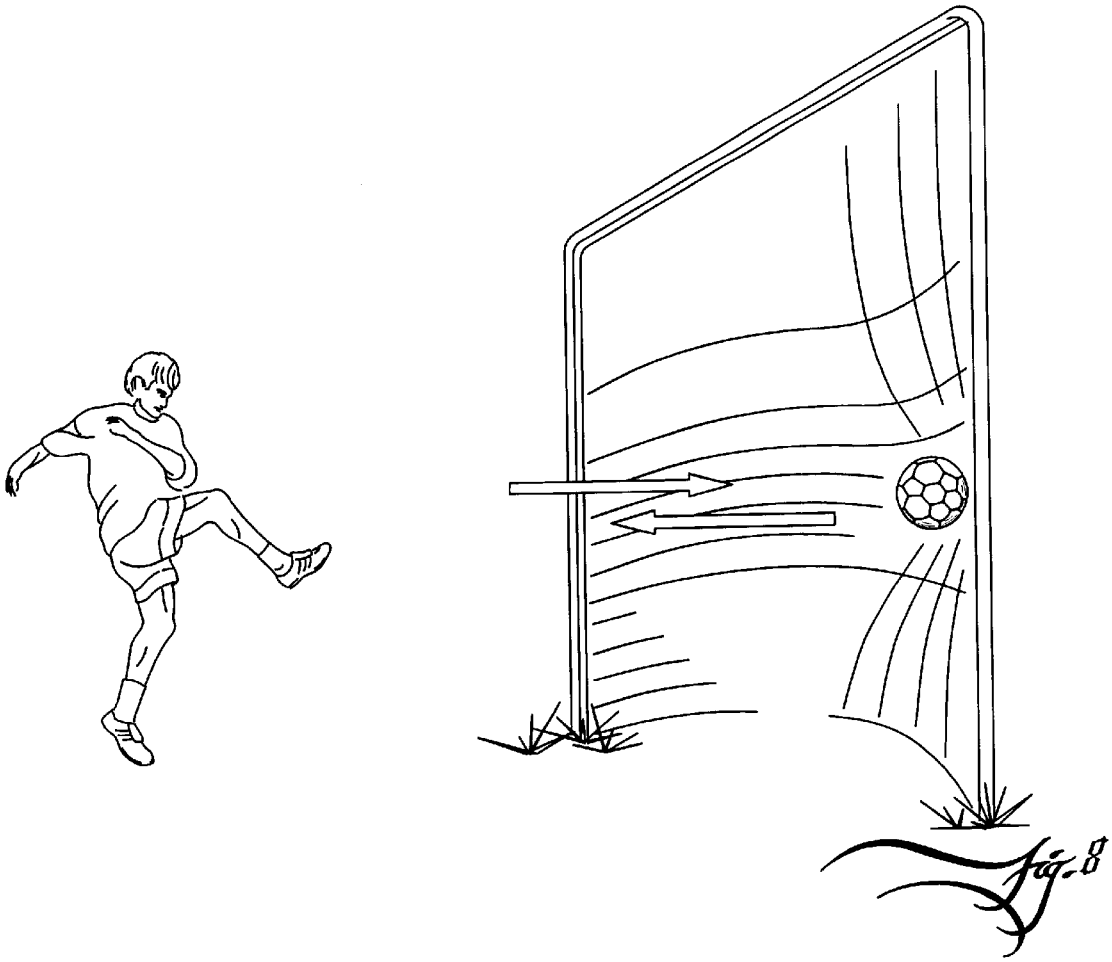
FIG. 8 is a pictorial view of a training method with the practice ball in accordance with the invention wherein a trainee is practicing power shots against a rebounding practice goal.

Soccer, needless to say, is more well-known as a game of skilled and at times powerful footwork. FIG. 8 is a pictorial view of a trainee practicing power shots against a rebounding practice goal. This practice goal is more particularly disclosed by U.S. Pat. No. 5,048,844, entitled "Portable Rebounding Soccer Training Goal," invented by the same inventor hereof. Practicing the power "shot" this way with the kick-strengthening practice ball 20$^n$ in accordance with the invention truly provides directly applicable "power" development as not otherwise attainable by weight training, plyometrics or whatever.

Soccer is a real team game. The team shifts as one unit and works together passing toward one goal. The final touch may be the most spectacular, but without the preceding passes, it couldn't have happened. Nonetheless, it's still the shot that gets all the attention.

The shot is the glory play. In the low-scoring soccer game, it's the only thing that the news picks up on. Even if the shot misses, it will frequently make the highlight film at 11:00. And if the ball goes in . . . well forget it. Then the clip is played over and over.

[Ellipsis is original.]

D. W. Crisfield, *The Complete Idiot's Guide to Soccer* supra, p. 101–02.

The kick-strengthening practice ball 20$^n$ allows a trainee to escalate practice intensity. That is, because the ball 20$^n$ is weighted, the trainee is doing more work in one kick (all things being equal). Several repetitions with the weighted practice ball 20$^n$ will reach the desired state of "overload" under the circumstances, which may not be attainable for a highly-conditioned athlete with a regulation game ball. As previously referenced, Your muscles will only grow when they are subjected to an overload. They will not respond to anything less. As you grow stronger, the only way to make your muscles to continue to grow is by increasing the amount of work you force them to do. This is most easily done by increasing the amount of weight you use in each exercise. By progressively adding on weight to keep pace with the growing strength of your body, you ensure that your muscles will always be working at their maximum capacity and therefore grow as fast as possible.

A. Schwarzenegger, *Encyclopedia of Modern Bodybuilding*, supra.

Figure 9:
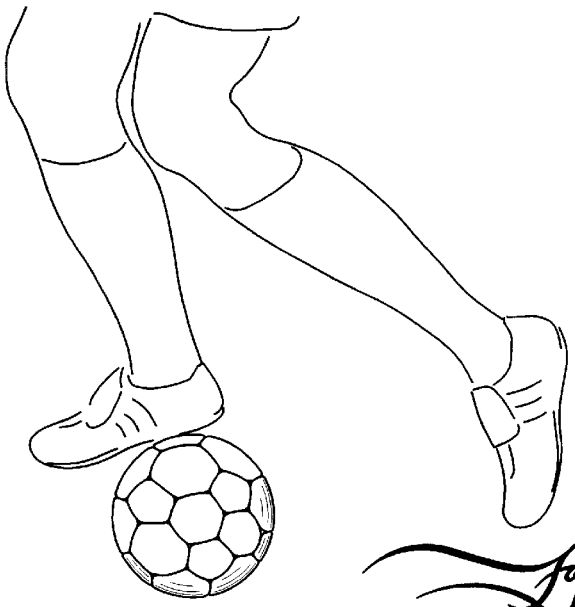
FIG. 9 is a pictorial view of a training method with the practice ball in accordance with the invention wherein a trainee is practicing driving (eg., shooting, clearing or downfielding) the inventive practice ball.
Figure 10:
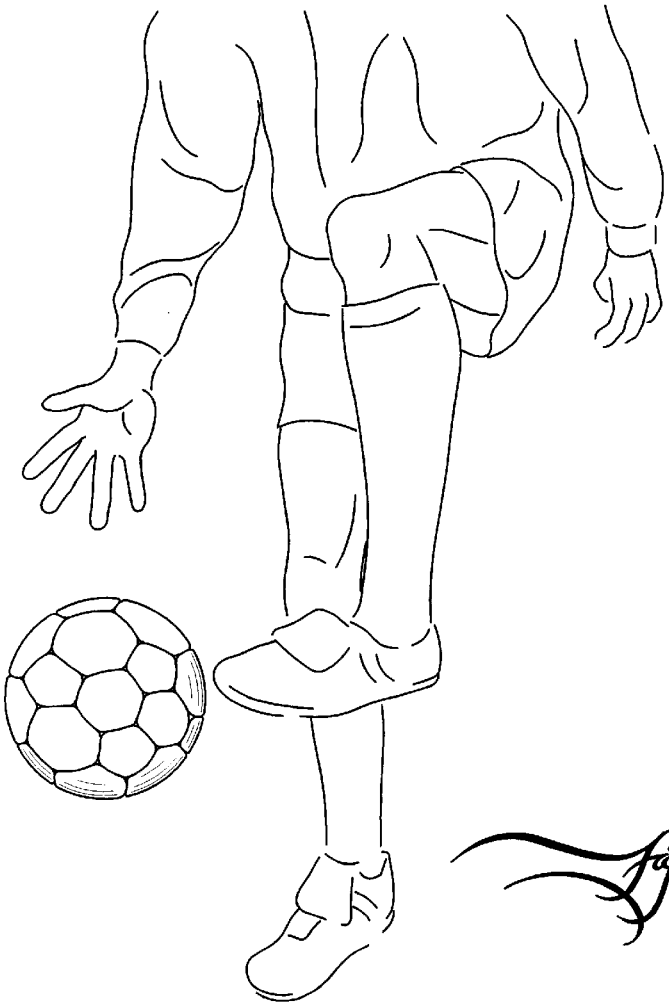
FIG. 10 is a pictorial view of a training method with the practice ball in accordance with the invention wherein a trainee is practicing keeper punting with the inventive practice ball.

FIGS. 9 through 18 show further inventive training programs incorporating the kick-strengthening practice ball 20$^n$ in accordance with the invention. FIG. 9 shows a training method in which a trainee is practicing driving (eg., shooting, clearing or downfielding) the inventive practice ball 20$^n$. FIG. 10 shows the trainee practicing keeper punting with the inventive practice ball 20$^n$.

Figure 11:
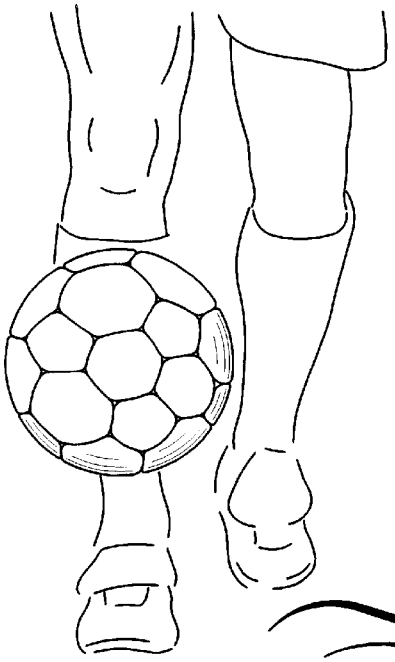
FIG. 11 is a pictorial view of a training method with the practice ball in accordance with the invention wherein a trainee is practicing standing-in place juggling with the inventive practice ball.
Figure 12:
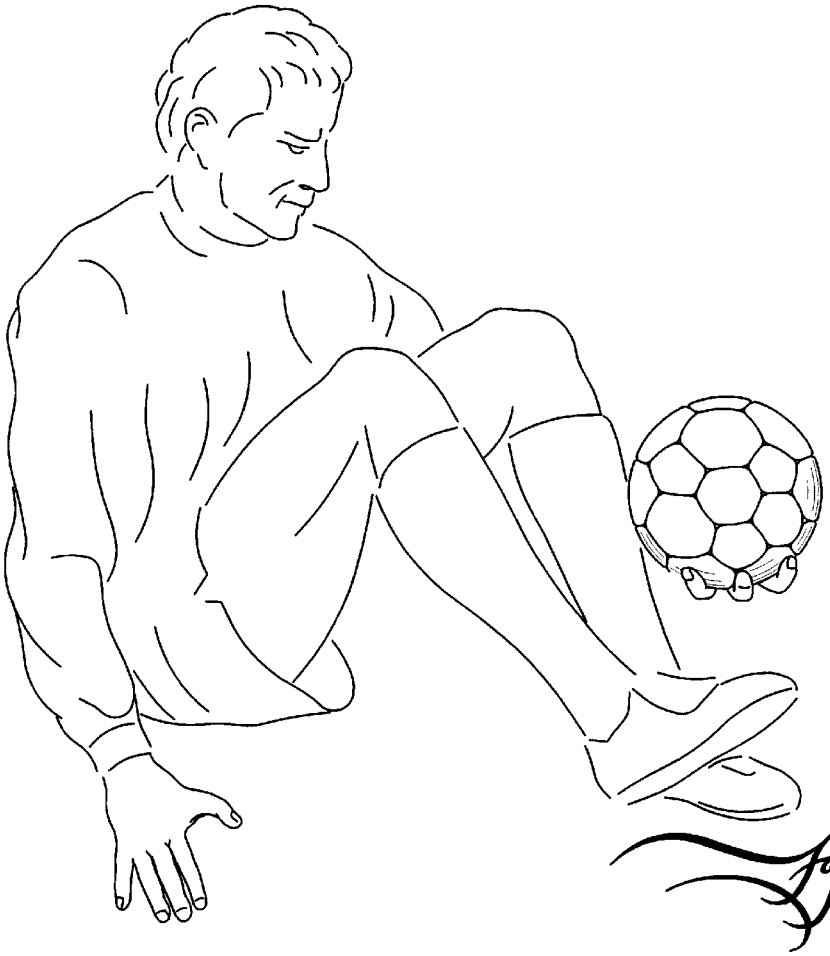
FIG. 12 is a pictorial view of a training method with the practice ball in accordance with the invention wherein a trainee is practicing seated-in place juggling with the inventive practice ball.

In FIG. 11 the trainee is practicing standing-in place juggling with the inventive practice ball 20$^n$. FIG. 12 comparably shows the trainee practicing seated-in place juggling with the inventive practice ball 20$^n$. The actual trainee-subject of these pictorial views personally attested that he tired of seated-in place juggling in about ten minutes with a 6 ounce (168 gram) weighted ball 20$^3$, when ordinarily he would not have expected overload until maybe after thirty minutes. This demonstrates what is well-know from weight training. Adding small amounts of weight escalate intensity by a manifold factor.

Figure 13:
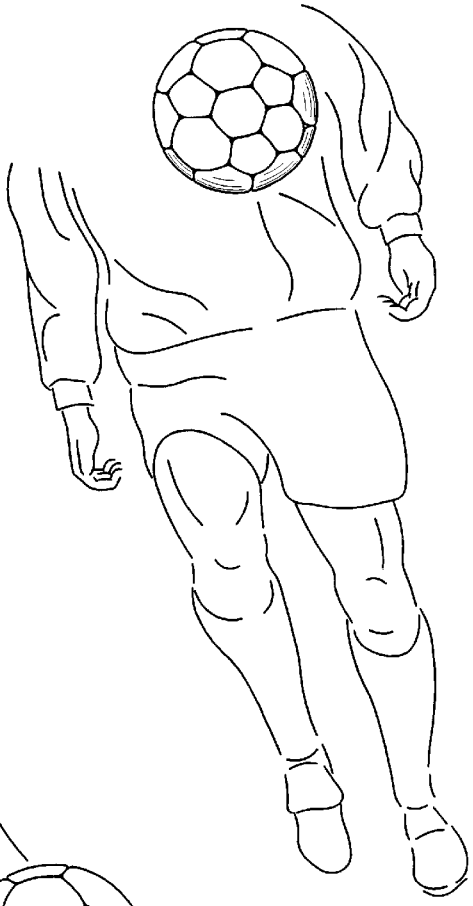
FIG. 13 is a pictorial view of a training method with the practice ball in accordance with the invention wherein a trainee is practicing trapping or controlling the inventive practice ball on his chest.
Figure 14:
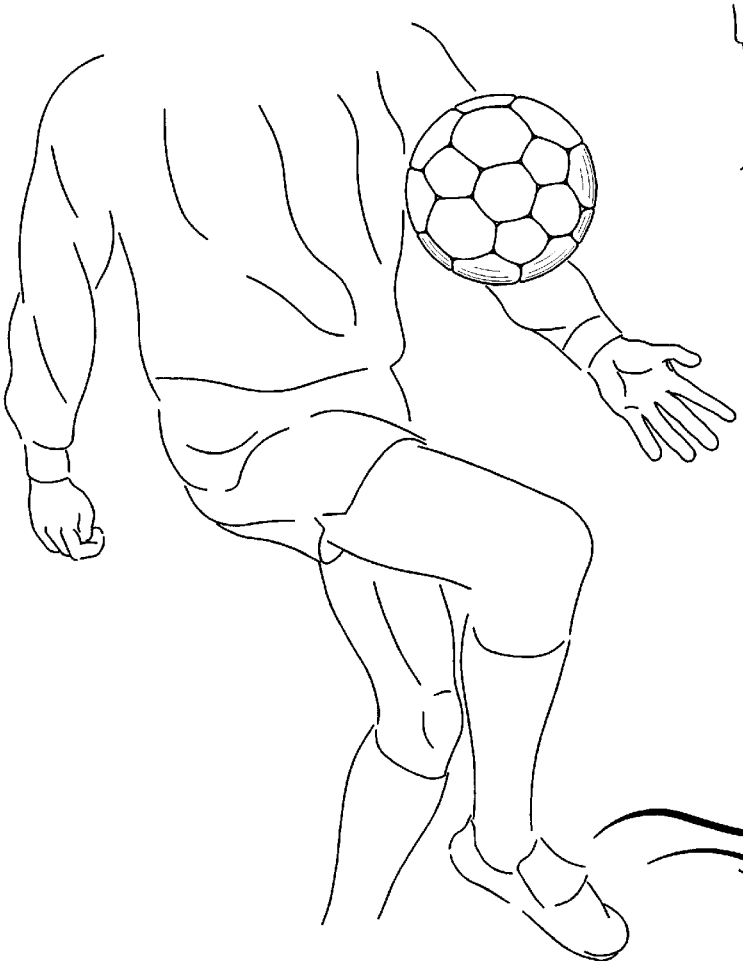
FIG. 14 is a pictorial view of a training method with the practice ball in accordance with the invention wherein a trainee is practicing standing juggling with the inventive practice ball as the trainee moves around a given course.
Figure 15:
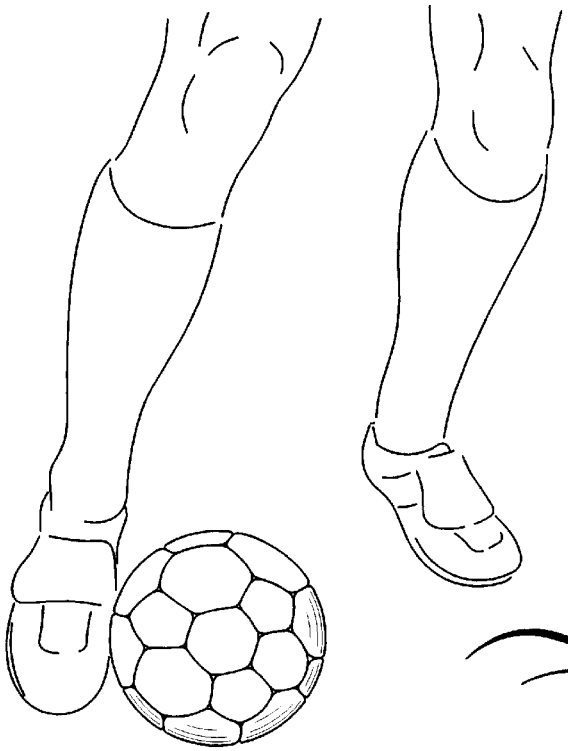
FIG. 15 is a pictorial view of a training method with the practice ball in accordance with the invention wherein a trainee is practicing trapping or controlling the inventive practice ball on the ground with his foot.
Figure 16:
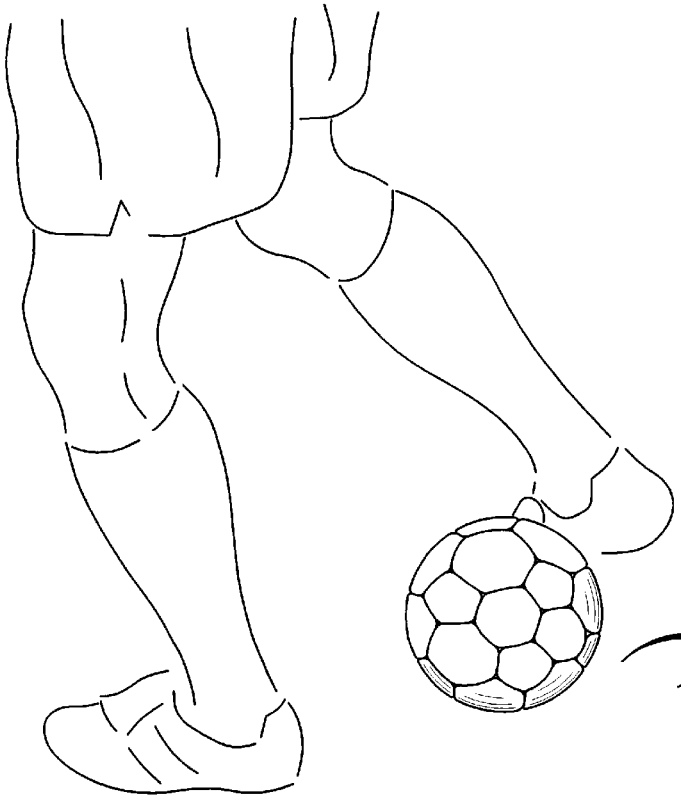
Figure 17:
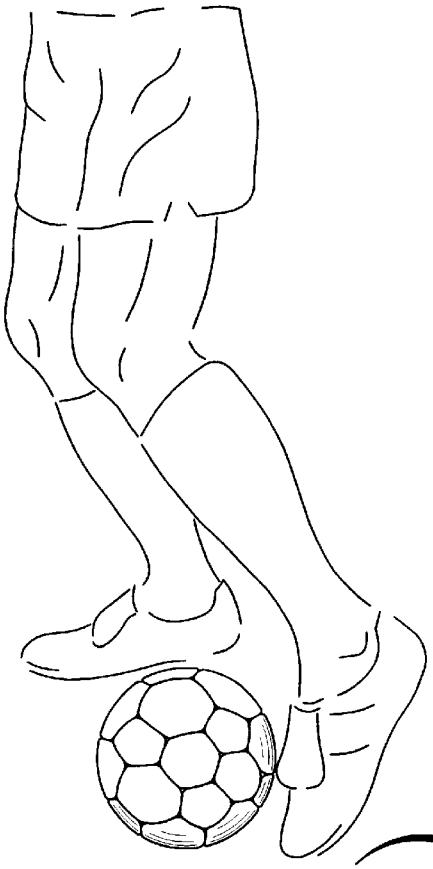
FIG. 17 is a pictorial view of a pass drill for "pushing" or passing the ball with a relatively light stroke.
Figure 18:
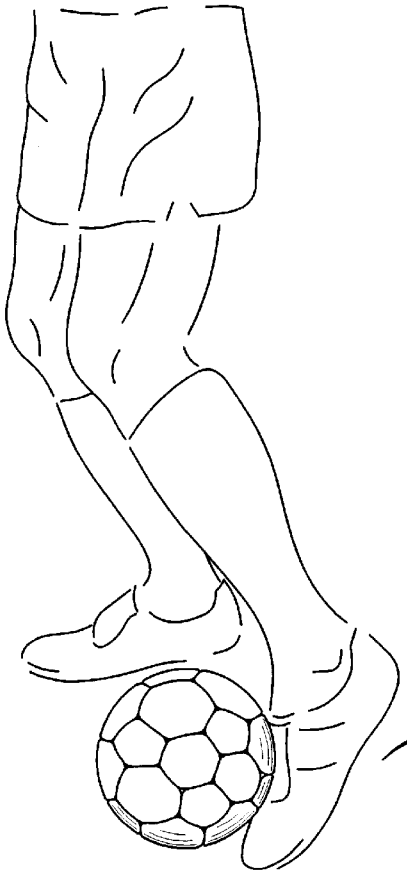
FIG. 18 is a pictorial view of a pass drill for "shooting" or passing the ball with a relatively stronger stroke.

As shown by FIG. 13 the trainee is practicing trapping or controlling the inventive practice ball 20$^n$ on his or her chest. In FIG. 14 the trainee is practicing standing juggling with the inventive practice ball 20$^n$, as the trainee moves around a given course. FIG. 15 shows the trainee practicing trapping or controlling the inventive practice ball 20$^n$ on the ground with his or her foot. FIG. 16 has the trainee practicing a passing drill with the inventive practice ball 20$^n$ such as feinting (eg., faking) a pass. As training is shown by FIG. 17, the trainee is practicing a pass drill for "pushing" or passing the ball with a relatively light stroke. In contrast, FIG. 18 shows the trainee practicing the pass drill differently as this time for "shooting" or passing the ball with a relatively stronger stroke.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A progressive series of kick-strengthening practice soccer balls each of which at an intended inflation pressure of about one (1) atmosphere at sea level has a progressively different weight, wherein each practice soccer ball comprises:

an inflatable bladder; and an outer casing, covering the bladder, formed of composite panels;

wherein all of the composite panels comprise an outer ply of tough durable carcass material and a subjacent ply of substantially non-stretchable, flexible sheath material for restraining expansion of the bladder when inflated to pressure and therefore reduce the outward pressure on the carcass material in combination with increasing the dimensional stability of each ball such that each ball of the series is approximately spherical and measures about the same in respect of outside diameter; and, wherein at least some panels furthermore include foam patches subjacent the sheath material, said foam patches being provided both to weight each ball for kick-strengthening purposes as well as to soften the impact when kicked, each ball of the series having a different number of patches such that ball weight increases in accordance with the increase in number of said patches.

2. The progressive series of kick-strengthening practice soccer balls of claim 1 wherein the weight of each inflated ball measures, excluding the foam, a baseline weight of about 14 to 16 ounces at sea level, plus an incremental amount more chosen from between about 1 and 10 ounces, the weight of the foam corresponding to the incremental amount.

3. The progressive series of kick-strengthening practice soccer balls of claim 1 wherein the weight of each inflated ball measures, excluding the foam, a baseline weight of about 14 to 16 ounces at sea level, plus an incremental amount more of about "n" ounce(s) such that "n" is an integer chosen from 1 to 10, the weight of the foam corresponding to the incremental amount.

4. The progressive series of kick-strengthening practice soccer balls of claim 1 wherein the panels are mated by sewn, seamed edges turned inward.

5. The progressive series of kick-strengthening practice soccer balls of claim 1 wherein:

each ball, excluding the foam, is substantially a FIFA International Matchball Standards ball that, when before use and inflated to between 0.6 and 1.1 atmospheres (600 and 1,100 millibar) at sea level:

is spherical, has a circumference measuring not more than 28 inches (71 cm) and not less than 27 inches (68-½ cm), and weighs not more than 16 ounces (396 grams) or less than 14 ounces (453 grams).

6. The progressive series of kick-strengthening practice soccer balls of claim 1 wherein:

for each ball the panels are provided in arrangements which utilize any of 32 in number, 18 in number, or 8 in number.

7. The progressive series of kick-strengthening practice soccer balls of claim 1 wherein:

for each ball the panels are provided in an arrangement of 32 in number, of which 12 are pentagonal and 20 are hexagonal, and, the foam is applied to one or the other of the pentagonal of hexagonal or panels only.

8. The progressive series of kick-strengthening practice soccer balls of claim 1 wherein:

the foam patches comprise one of synthetic, natural, or admixture of synthetic and natural foam or sponge rubber.

9. A progressive series of kick-strengthening practice soccer balls each of which at an intended inflation pressure of about one (1) atmosphere at sea level has a progressively different weight, wherein each practice soccer ball comprises:

an inflatable bladder;

a carcass of tough durable material;

an intermediary sheath of substantially non-stretchable, flexible material for restraining expansion of the bladder when inflated to pressure and therefore reduce the outward pressure on the carcass material in combination with increasing the dimensional stability of each ball such that each ball of the series is approximately spherical and measures about the same in respect of outside diameter; and, a shock-absorbing weighting material interposed between either the bladder and sheath or sheath and carcass, said weighting material being provided both to weight each ball for kick-strengthening purposes as well as is shock-absorbing to soften the impact when kicked, each ball of the series having a different amount of weighting material included such that ball weight increases in accordance with the increase in amount of weighting material.

10. The progressive series of kick-strengthening practice soccer balls of claim 9, wherein the weighting material comprises one of synthetic, natural, or admixture of synthetic and natural foam or sponge rubber.

11. The progressive series of kick-strengthening practice soccer balls of claim 9, wherein the weighting material comprises substantially a continuous layer.

12. The progressive series of kick-strengthening practice soccer balls of claim 9, wherein the weighting material is distributed in patches, substantially in a symmetric distribution in a spherical geometry, for lessening imbalance.

13. The progressive series of kick-strengthening practice soccer balls of claim 12, wherein the sheath is a woven material immediately subjacent and bonded directly to the carcass, the patches of weighting material being disposed between the sheath and bladder and being nominally fixed in place to the sheath during production by adhesive.

14. The progressive series of kick-strengthening practice soccer balls of claim 9 wherein the weight of the inflated ball, excluding the weighting material, measures a nominal baseline weight of about 15 ounces at sea level, plus an incremental amount more chosen from between about 1 and 10 ounces, the weight of the weighting material corresponding to the incremental amount.

15. The progressive series of kick-strengthening practice soccer balls of claim 9 wherein the weight of the inflated ball, excluding the weighting material, measures a nominal baseline weight of about 15 ounces at sea level, plus an incremental amount more of about "n" ounce(s) where "n" is an integer chosen from 1 to 10, the weight of the weighting material corresponding to the incremental amount.

16. The progressive series of kick-strengthening practice soccer balls of claim 9 wherein:

the ball, excluding the weighting material, is substantially a FIFA International Matchball Standards ball that, when before use and inflated to between 0.6 and 1.1 atmospheres (600 and 1,100 millibar) at sea level:

is spherical, has a circumference measuring not more than 28 inches (71 cm) and not less than 27 inches (68-½ cm), and weighs not more than 16 ounces (396 grams) or less than 14 ounces (453 grams).

17. The progressive series of kick-strengthening practice soccer balls of claim 9 wherein the carcass material is chosen from one of leather or a synthetic material.

18. A progressive series of soccer balls each of which at an intended inflation pressure of about one (1) atmosphere at sea level has a progressively different weight, wherein each soccer ball comprises:

an inflatable bladder;

a carcass of tough durable material; and an intermediary sheath of substantially non-stretchable, flexible material for restraining expansion of the bladder when inflated to pressure and therefore reduce the outward pressure on the carcass material in combination with increasing the dimensional stability of each ball such that each ball of the series is approximately spherical and measures about the same in respect of outside diameter; and, wherein at least more than one of the balls of the series includes a shock-absorbing weighting material interposed between either the bladder and sheath or sheath and carcass, said weighting material being provided both to weight the respective ball for progressive kick-strengthening purposes as well as is shock-absorbing to soften the impact when kicked, each ball of the series weighing a different amount in accordance with the difference in amount of weighting material that is included, if any.

19. The progressive series of kick-strengthening practice soccer balls of claim 18 wherein the weight of the inflated ball excluding the weighting material, if any, measures a nominal baseline weight of about 15 ounces at sea level, plus an incremental amount more chosen from between about 1 and 10 ounces, the weight of the weighting material corresponding to the incremental amount.

20. The progressive series of kick-strengthening practice soccer balls of claim 18 wherein the weight of the inflated ball excluding the weighting material, if any, measures a nominal baseline weight of about 15 ounces at sea level, plus an incremental amount more of about "n" ounce(s) where "n" is an integer chosen from 1 to 10, the weight of the weighting material corresponding to the incremental amount.

* * * * *